United States Patent [19]

Schmanski

[11] 4,342,168

[45] Aug. 3, 1982

[54] FLEXIBLE STREET SIGN BLANK

[76] Inventor: Donald W. Schmanski, P.O. Box 1298, Carson City, Nev. 89701

[21] Appl. No.: 224,270

[22] Filed: Jan. 12, 1981

[51] Int. Cl.[3] ..... G09F 15/00

[52] U.S. Cl. ..... 40/607; 40/616

[58] Field of Search ..... 52/165; 40/606, 607, 40/612, 616

[56] References Cited

U.S. PATENT DOCUMENTS

| | | | |
|---|---|---|---|
| 4,040,194 | 8/1977 | Penton et al. | 40/607 |
| 4,124,197 | 11/1978 | God, Jr. | 40/612 |
| 4,249,357 | 2/1981 | Cornou | 40/612 |
| 4,253,415 | 3/1981 | Ferch | 40/612 |
| 4,262,438 | 4/1981 | Scherer | 40/607 |

FOREIGN PATENT DOCUMENTS

| | | | |
|---|---|---|---|
| 1054486 | 1/1967 | United Kingdom | 40/612 |

*Primary Examiner*—Gene Mancene
*Assistant Examiner*—Wenceslao J. Contreras
*Attorney, Agent, or Firm*—Thorpe, North & Western

[57] ABSTRACT

A flexible resin and fiber composite street sign blank adapted for attachment to a rigid bracket and signpost. The sign blank comprises a planer web section whose material composition and fiber arrangement provide a tensile strength of at least 25,000 psi and preserve flexibility to enable the sign blank to withstand impacts and other destructive influence. The web section is bounded along one or both of its long sides with an elongate rail section which has at least twice the thickness of the web thickness. The rail section has a material composition and fiber arrangement which provide a minimum tensile strength of at least 40,000 psi and develop an improved compliance match for attachment at the rigid bracket and signpost.

6 Claims, 7 Drawing Figures

FLEXIBLE STREET SIGN BLANK

BACKGROUND OF THE INVENTION

Street signs are a familiar device to both pedestrians and vehicle drivers. They are part of the class of signs designated as "guide signs" and are found on virtually every street corner to assist the public in street name identification.

Such street signs remain useful only as long as they are properly oriented with respect to the roads or intersections and are in a proper upright configuration to enable immediate recognition by the public. Such immediate observation is necessary in view of the need for motorists to travel at a normal traffic flow rate. Where the driver has to slow down or stop to locate a street sign, a safety risk arises to both pedestrian and vehicle drivers by reason of confusion and traffic congestion typically caused by such action.

To facilitate immediate recognition of street signs as well as other traffic signs, uniform sign shapes have been required by federal legislation. The guide signs have been designated to have a rectangular shape with the long side being horizontal with respect to the ground. A typical street sign in compliance with this configuration is shown in FIG. 1. In this case, two sign blanks 10 and 11 are shown as typically mounted for identification of an intersection of two streets. The size of each blank may range from six inches in height and twenty inches in length, to nine inches in height and fifty inches in length. The size will depend on the speed of traffic and the need for visual awareness on the part of the driver at extended distances.

The configuration illustrated in FIG. 1 is a sign blank combination which is centrally mounted on a post 12 which would probably be located on one or more corners of the intersecting streets. Such posts are typically made of galvanized steel or other sturdy metals capable of supporting the weight of the sign blanks. In accordance with current safety practices, such a street sign-post should be of a "breakaway" post which would fail or shear on impact by a vehicle. The safety considerations suggesting the use of breakaway posts are based on the principle that less damage will be done to the vehicle and driver if the post is capable of giving way at impact. Obviously, other safety risks arise by virtue of a post which now may become a flying projectile capable of injuring bystanders.

This hazard is developed by the material composition currently used for street sign blanks. In a report titled "Model Standards for Street Name Signing" prepared by the Uniform Ordinances and Practices Committee of the Southern California Chapter of the American Public Works Association, in 1977, a survey revealed that one-half of such street signs were construed of box-type aluminum or porcelainized steel and the other half were of a blade-type aluminum. It is apparent that the use of the aluminum or steel material as sign blank composition greatly increases the risk of injury when such sign blanks are attached to breakaway posts which may be hurled through the air upon vehicle impact. Despite this risk virtually all street sign blanks continue to be made of these respective metals. This is due in part to the need for stiffness and rigidity in the street sign to ensure its maintenance of proper orientation and stability in the wind.

The street sign blanks such as shown in FIG. 1 are typically mounted by brackets in a crosswise orientation. A post bracket 13 is used to couple the first sign blank 11 to the upright post 12. An interlocking bracket 14 is used to attach the top sign post 10 in crosswise orientation to its supporting sign post 10 in crosswise orientation to its supporting sign blanket 11. These brackets are usually constructed of aluminum and are locked in place by various nut and bolt combinations.

Viewing the current street sign combinations as a whole, it is noted that a high level of rigidity occurs throughout the structure. This rigidity supplies the required stability throughout the post, brackets and sign blank combination. Although such stability is desirable for maintaining proper sign orientation, other problems and disadvantages exist which suggest the need for an improved sign blank material.

For example, one problem with the metal sign blank construction arises because of its rigidity. Specifically, the metal sign blanks will deform on impact and will remain in a bent or misfigured configuration. Once the street sign has been bent out of shape it frequently is difficult for a driver to properly identify the street designated. A preferred structure would incorporate flexibility or elastic character which would restore the sign blank to its proper form.

Unfortunately, this problem of metal deformation due to impact is well-known to vandals. In fact, the deformation of street signs is more commonly caused by deliberate vandalism rather than impact from vehicles or by objects extending from vehicles.

A further problem arises because of the commerical value of aluminum in the present market. The rigid structure of the aluminum sign blank greatly facilitates its theft because it may be broken away from the bracket by a quick twist or jerk. Consequently, many aluminum sign blanks are stolen each year for the sole purpose of resale of the aluminum material.

An additional problem somewhat complimentary to the previous problem noted is the high cost of purchase and replacement for the aluminum and steel sign blank. Quite typically, the purchase of sign blank materials is not a onetime expenditure due to vandalism and other problems, the metal sign blanks must be replaced on occasion. Such replacement costs are quite significant in view of the large number of street sign blanks which are used in any particular city.

A final problem which should be noted is the added risk of injury supplied by a metal sign blank attached to a flying projectile such as a breakaway post. Following impact by a vehicle, the breakaway post shears or splits near ground level and may become a flying object. The attached metal blades at the end of the post, having a high mass, are a hazzard to both property and human life.

The seriousness of these deficiencies is further enlarged by the number of such signs involved. When one considers that every street and intersection must be identified at virtually every intersection, the number of such street signs becomes staggering. Despite the tremendous expense and noted deficiencies of the standard metal street sign configuration, very little improvement has been developed. Specifically, the inventor herein is aware of no attempts to change material composition away from the original metal street sign blanks.

Although no attempts have been made to deal with the problems of high mass and expense of metal street sign blanks, some efforts were made toward changing material composition in regulatory signs such as stop signs and the like. These attempts included the use of fiberglass matt or fabric resin composite materials whose dimensions roughly conformed to the original dimension of the metal sign being replaced. Although the fiberglass material has the advantage of reduced cost and lighter weight, its use was abandoned in view of material failure following attachment to the rigid sign post or other mounting means. As a consequence, the use of fiberglass material as regulatory sign blanks was short-lived.

Other uses of fiberglass as sign material have since emerged. Some signs which are fixed in a rigid frame or which are affixed against a rigid wall have demonstrated the favorable characteristics of weatherability and general utility in an outside environment. Such uses have been limited, however, to methods of attachment which rigidly fix the sign blank such that it is immobilized and unable to vibrate in the wind. In circumstances where an unframed sign blank has been attached to a rigid post or at one of its edges, the material fails at the attachment point and the sign blank proves to be unserviceable.

Other uses have been made of fiberglass composition in connection with signs, as illustrated in U.S. Pat. No. 2,782,544 by Tobin. This disclosure, however, deals only with the manufacture of a sign whose inscription is given a crystalline or sparkling appearance when viewed in the light. This crystalline characteristic is provided by fiberglass which is inlayed in a sign blank with the desired lettering or design format. The inventor is aware of no prior art disclosure as to any specific utility for fiberglass as sign material to be attached to a rigid metal post.

Therefore, in the field of guide signs, as well as other regulatory signs whose method of mounting or attachment consists of bolting the sign blank to a rigid post, the typical means for identification continues to be by a method utilizing metallic sign blanks. As previously noted, the problems inherent in this material include a high cost for initial purchase and subsequent maintenance, with an attendant high risk of theft and vandalism. Furthermore, the risk of such rigid blanks as part of sign material along highways and streets provides added danger to the public when such posts are struck by moving vehicles. What is needed, therefore, is a sign blank material which is inexpensive and durable in the weather, but flexible enough to avoid the need for regular maintenance and light in weight to reduce the risk of injury and damage when struck by moving vehicles.

OBJECTS AND SUMMARY OF THE INVENTION

It is an object of the present invention, therefore, to provide an improved guide sign blank having the desired safety features of low mass, flexibility and minimal cost for materials and production.

It is a further object of this invention to provide an improved street sign blank which is adapted to reduce the occurrences of theft and effects of vandalism.

It is an additional object of this invention to provide a street sign blank of fiber reinforced plastic composition which can be attached to a rigid bracket and sign post combination, yet will not fail or break in response to recurring winds and vibrational motion.

It is a still further object of this invention to provide an improved sign blank requiring minimal maintenance or repair effort.

These and other objects are realized in a flexible resin and fiber composite regulatory sign blank designed for attachment to a rigid bracket and signpost combination such as is currently used to support aluminum and other metal street sign devices. The composite street sign blank of the present invention comprises a web section for carrying the street name identification. This web section is the more flexible part of the street sign and enables the sign to withstand impact without breaking. To enable its attachment to a rigid bracket and signpost, the web section is integrally formed with a rail section having a thicker dimension, greater tensile strength and higher modulus than the web section. This rail operates as an intermediate transmission media for energy absorption from the web section, as well as an improved material match in compliance with the more rigid metal bracket which forms the means for attaching the street sign blank to a signpost. The resultant strength and stiffness in the rail minimizes the material breakdown and failure at the mounting points with respect to the metal bracket. This structure enables the use of lightweight fiber reinforced plastic which has the attendant benefit of minimal expense, flexibility to withstand minor impacts and low mass for safety considerations.

These and other objects will be apparent to those skilled in the art in view of the detailed description of preferred embodiments of this invention, in combination with the drawings attached hereto.

DETAILED DESCRIPTION OF THE DRAWINGS

Figure 4:
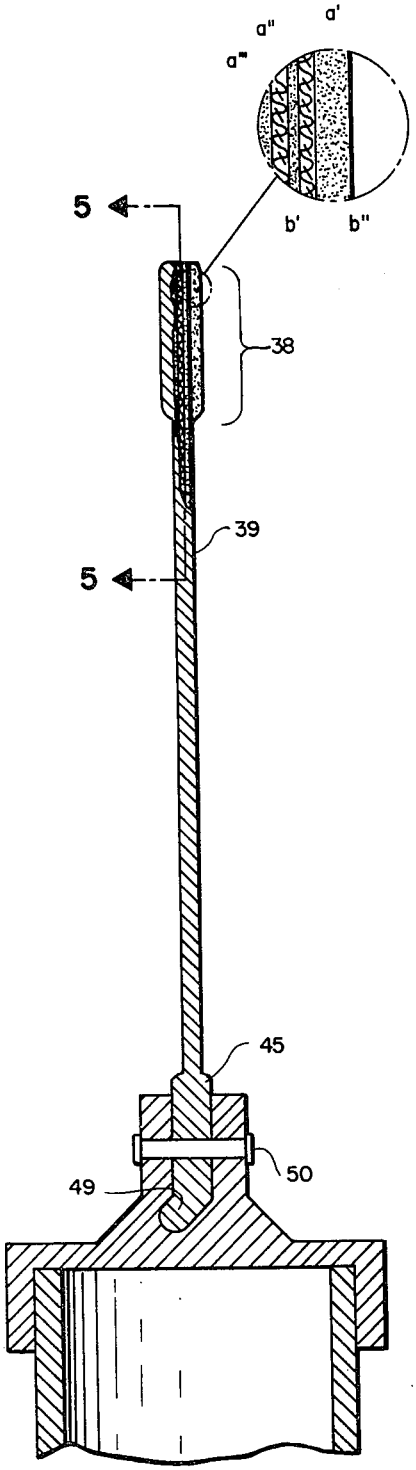
FIG. 4 shows an additional embodiment having a cross-section in the same location as the cross-section of FIG. 3 and having a portion of rail section in cut away view.
Figure 5A:
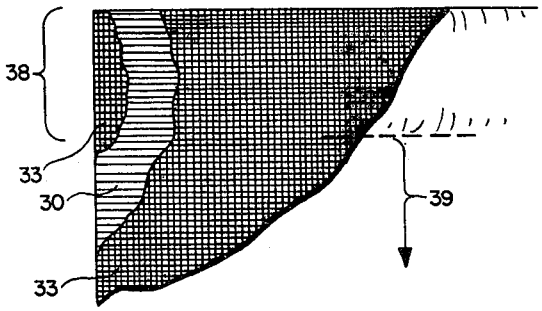

FIGS. 5*a*, *b* and *c* show several fiber arrangements within a sign blank such as FIG. 4.

DETAILED DESCRIPTION OF THE INVENTION

This invention arises, in part, from the inventor's discovery that prior failures of fiberglass and reinforced plastic sign blanks were due to mismatch of compliance and elastic modulus between the metal mounting post or bracket and the reinforced plastic material of the sign blank. It was noted by the inventor that mounting a planar sign board of resin and fiberglass, (matt or fabric) composition on a rigid post or mounting clip would lead to material failure within a short time. Specifically, the fiberglass material surrounding the washer or bolt where the board was affixed would crack or otherwise fail due to fatigue and result in the collapse of the signboard from the post.

This failure of material at the point of attachment was particularly rapid when the sign blank was exposed to winds which developed a vibrational motion in the signboard. Over an extended period of time, this continual vibration of the fiberglass material against the rigid washer or bolt which mounted this fiberglass board to the signpost caused cracks and general material failure until eventually the signboard simple fell from its position.

The inventor, as noted herein, has discovered that a major cause for this failure is the mismatch in elastic modulus and compliance of the fiber reinforced material and the attaching bolt and washer to the signpost. By increasing the stiffness and tensile strength of the signboard at the point of its attachment and by reducing these properties in the web section of the sign, the compliance of the signboard can be made compatible mechanically with the mounting clip or washer and bolt combination. Furthermore, by extending this stiffer section (herein referred to as the rail) along the length of the signboard, the stability of a fiber reinforced composite sign blank can be improved so that it retains the primary benefits of a metal sign blank. As used hereinafter, composite shall refer to a resin/fiber composition wherein the combination includes a proper balance of longitudinal fibers (roving) and fibers having a transverse component (fabric or matt), this fiber combination being further differentially balanced in relative composition between the rail and web sections. Therefore, the more favorable characteristics of the metal sign blank can be developed in a fiber reinforced composite material by proper balancing of fiber composition in the rail and web sections within the sign blank structure.

For example, one significant advantage of the metal sign blank over the prior art fiberglass structure was the stability of the metal blank in the wind. Typically, this prior art fiberglass structure consisted of a layer of reinforcing fabric or random matt imbedded in a resin binder. This fiberglass sign structure would vibrate sufficiently in the wind to cause fatigue and subsequent failure. In fact, this is the major cause for the abandonment of use of fiberglass and return to the more stable metal structure within the general sign industry. The present invention not only provides such stability, but concurrently incorporates flexibility which does not exist in metal sign structures.

Figure 1:
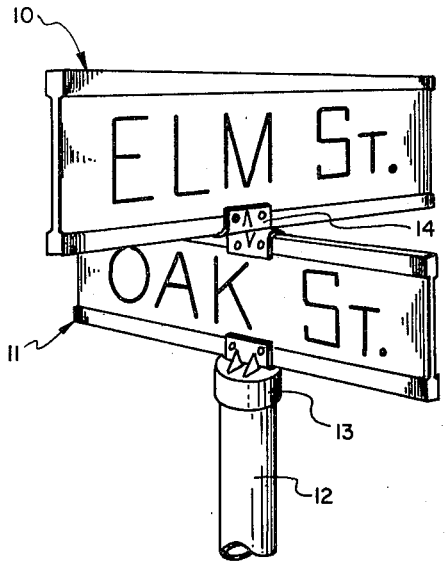
Fig. 1 (PRIOR ART)
FIG. 1 illustrates a typical prior art street sign combination utilizing aluminum sign blanks as the sign element.
Figure 2:
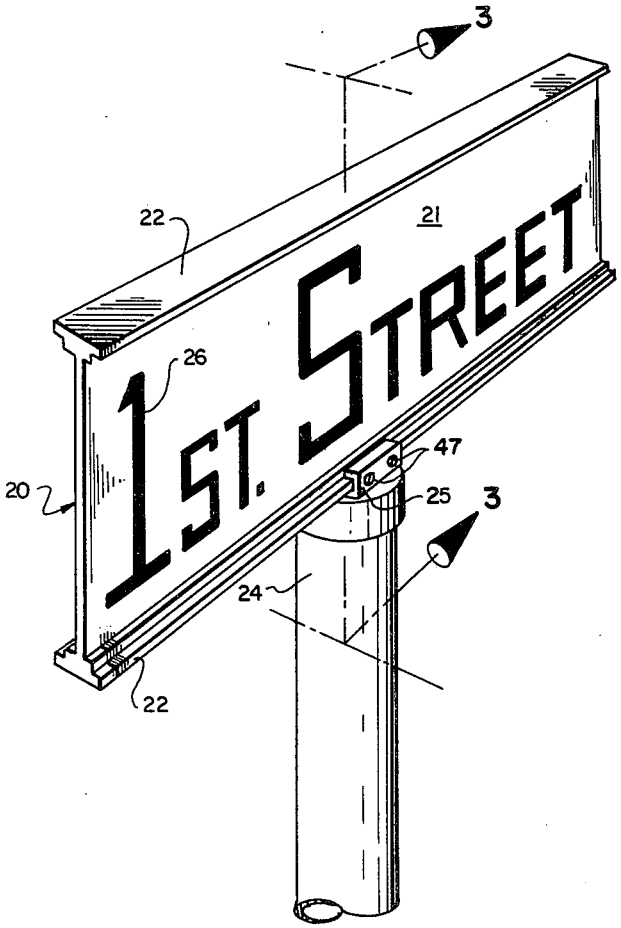
FIG. 2 depicts a perspective view of a segment of a street sign blank structured in accordance with the present invention.

In accordance with the principles of this invention, FIG. 2 illustrates a sign blank 20 which includes a web section 21 and a pair of rails 22 which are integrally formed with the web section. The rail 22 and web 21 sections are structured with a proper balance of fiber orientations and content to develop the strength required to survive an impact, to preserve adequate rigidity and to provide compliance matching of the sign blank material with the compliance of the sign post and mounting clip. The web section 21 is sufficiently thin to enable flexible response to impact from projecting objects from trucks or cars, as well as attacks of vandalism and other forms of mischief. By virtue of the thin structure of the web, the sign blank is able to deform and twist so as to dissipate the energy of the impact without breaking or otherwise losing sign utility. The rails 22, on the other hand, are sufficiently thick to establish stiffness within the sign blank so that it can withstand wind and other natural phenomenon without wobbling or otherwise losing its functional purpose of presenting a stable sign face. The strength and rigidity of this rail section is further complimented by a heavy content of roving or longitudinal fibers.

Such a structure is ideally suited for the art of pultrusion wherein the reinforcing fibers are soaked in a thermosetting resin bath and pulled through a die whose opening configuration conforms to the desired cross-sectional shape of the sign blank. This process of pultrusion is a well-known art and is well adapted for manufacturing processes of products having a uniform cross-section which can be cut to any desired segment length such as that required for a street sign blank. In view of the fact that the pultrusion field is a well-developed technology, further explanation of actual manufacturing procedures is not necessary. Such procedures are well within the skill of the ordinary artisan, based on the disclosure of information provided herein.

As previously indicated, the street sign blank of the present invention incorporates a flexible web section 21 which can be attached to a rigid post 24 and bracket 25 by means of a stiff rail section 22 whose compliance or stiffness is more compatible with the high elastic modulous of the post and bracket, as compared to the more flexible web 21. The structure of the web section 21 is rectangular to comply with governing regulations which apply to such guide signs. It will be apparent that other geometries can be selected or developed using the protrusion and cutting the pultruded material to the specific shape desired.

In view of its method of manufacture in pultrusion, the opposing faces of the web section 21 will generally be parallel and planar. The street name markings 26 can be applied to these by numerous methods including painting, pressure sensitive or heat activated reflective material and other forms of surface-applied markings. There are also methods within the state of the art which would permit an inlaid structure of the markings within the web body.

The thickness of the web section will vary depending on the size of the street sign length to be formed. Standard sizes within the industry range from six to nine inches along the vertical or short side of the sign blank and twenty to sixty inches along the horizontal or longer side. Based on these standard sizes, a thickness range for the web section 21 of the sign blank would be between 0.045 and 0.250 inches. Again, the specific thickness may be based on the size of the sign blank used.

For example, a street sign blank having dimensions of 6×20″ may have thicknesses taken from the lower range from 0.045 inches. Where the climate conditions, wind and other servicability factors are favorable, the thinner structure may be acceptable. In environments where heavier winds occur the web thickness for a 6×20″ sign blank may extend up toward 0.200 inches, giving much greater stability, but having slightly increased material cost. Similar thickness considerations apply to the larger signs having dimensions extending up to 9×50″. Such larger sign structure may require a thicker web falling within the upper range of the original 0.045 to 0.250 range indicated.

The reduced thickness of the web section and attendant flexibility are realized by a proper balance of fiber content and orientation within the sign composite. As illustrated in FIGS. 5*a, b* and *c*, the web section is reinforced with longitudinal or roving fibers 30, 31 and 32 which are continuous along the length of the web section. To provide additional strength in a transverse orientation with respect to the longitudinal fibers 30, 31 and 32, additional fiber material 33, 34 and 35 is encapsulated within the web section with the longitudinal fiber. This latter fiber material has a transverse fiber component with respect to the longitudinal fibers 30, 31 and 32. Although this method of overlaying roving and fabric or matt to develop transverse strength is known in the art, it has not been applied to preparation of a guide sign to obtain compliance properties compatible with those of a rigid street sign post.

Figure 5B:
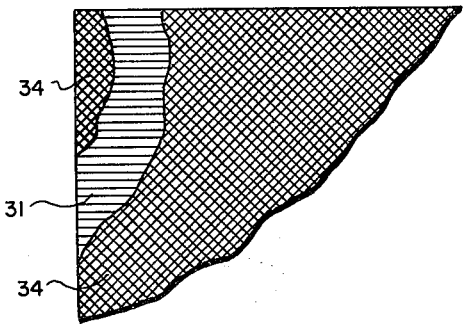
Figure 5C:
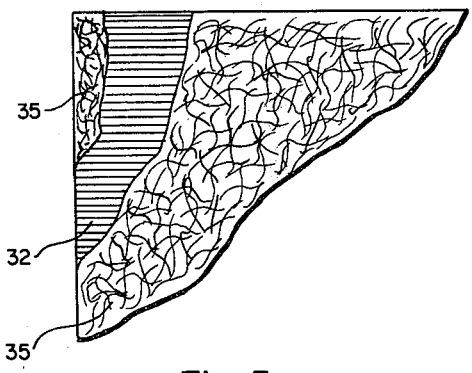

The transverse fiber component of the random matt 35 illustrated in FIG. 5*c* comprises the random fiber whose orientation diverges from the longitudinal axis. In the FIGS. 5*a* and 5*b*, this transverse component is developed by fibers such as woven fabric 33 and 34 which have either a warp and/or fill component in the transverse direction. The use of either fabric or random matt is considered to be substantially equivalent within the industry and will develop comparable response within the street sign blank. The rails are likewise formed with a combination of longitudinal and transverse fibers.

The problem of constructing a street sign blank which responds at the point of attachment in a matter similar to that of metal, but retains flexibility to improve survivability, is overcome by selective and controlled alignment of fibers within these web and rail sections. The use of longitudinal fiber or roving in both web and rail enables an increase in elastic modulus as well as improved strength along the length of the sign blank. The rails are loaded to a much greater extent with roving to bring the elastic modulus in close range to the modulus of the metal mounting clip and sign post. This also improves the rigidity of the sign for acceptable stability and performance in high winds.

FIGS. 4 and 5 illustrate a preferred sandwiched arrangement of the longitudinal or roving fibers. Elements a' and a''' depict the increased thickness of the rail sections 38 having a heavy concentration of roving within the sides of the rail. This roving is represented by the dots shown which correspond to longitudinal fiber ends projecting out of the page. Element a'' depicts a core layer of roving which is continuous from the rail section 38 through the web section 39, and into the opposing rail 45.

Elements b' and b'' represent the second fiber element of this structure, comprising fibers having the referenced transverse component (referred to hereinafter as "transverse fibers"). These transverse fibers complement the longitudinal strength of the roving to provide transverse strength in orientations away from the longitudinal axis of the sign blank. This transverse fiber b' and b'' is sandwiched between the roving a' and the sides of the rails and encloses the core layer of roving a''. This inner sandwich arrangement of b'–a''–b'' also continues from the respective rail sections 38 and 45 into the web 39.

The amount of fiber placement and orientation within the respective web and rail portions of the sign blank is based on a design limitation referred to herein as the "balanced anisotropic strength parameter." This parameter is expressed in terms of tensile strength (psi) and represents the strength developed in a given direction based on the contribution of combined longitudinal and transverse fiber with resin binder within the material of the web or rail. This parameter is determined separately for the rail and web sections without influence from the other parts of the sign blank. This design parameter is an approximation of the acceptable physical properties (i.e. elastic modulus, moment of inertia) and composition necessary within the composite web and rail structure to develop the desired rigidity, strength, resilience and flexibility to function as a composite street sign blank.

The need for use of the term "balanced anisotrope strength parameter" (hereinafter referred to as BASP) arises from the fact that although each element (fibers and liquid resin) going into the pultruded structure has its own tensile strength and elastic modulus properties, the union of these materials into a single composite with various divergent fiber combinations and orientations, results in the formation of a single anisotropic material which is unique. This final product takes on a new set of properties which reflect a unique composition of matter unlike the individual elements in their pre-reaction state. These properties include a new tensile strength which varies over different directions within the pultruded sign blank. In view of the fact that this "new" tensile strength is a single property reflecting the cumulative effect of multiple fiber orientations, each of which contributes to the strength in all directions, as well as the contribution of resin and fiber types, the use of the term "balanced anisotropic strength parameter" (BASP) is intended to incorporate these design aspects into this single tensile strength value. Therefore BASP is a property which reflects design features involving the balance of longitudinal and transverse fiber composition within a composite to realize tensile strengths within above certain minimum values determined to be necessary to develop the desired sign blank properties. The number of variations meeting these minimum values is further limited by a range of web and rail thicknesses disclosed herein as compatible with the subject invention.

The method of design involves balancing the amount, type and orientation of fiber so that minimal material is used to realize an anisotropic relationship between the BASP in longitudinal orientation versus that of the transverse direction. The anisotropic character of this structure is essential to an effective composite sign blank and will always have a substantially greater BASP value along the longitudinal direction over transverse direction. Minimum values for BASP in the sign blank are as follows:

a. In the web section, at least 25,000 psi longitudinally and at least 5,000 psi vertically; and b. In the rail section, at least 40,000 psi longitudinally and 5,000 psi in the vertical direction.

These minimal values are required to ensure a proper balance of high modulus for rigidity and minimal thickness for flexibility in the respective transverse and longitudinal directions.

Although some stiffness is realized by the structure outlined for the thin web section 21, the primary stiffness of the sign blank is developed by use of the thicker elongate rail section 22 which extends along at least one of the horizontal sides of the web section. It should be noted that the rail section is integral with the web section, the combination being formed concurrently as a single structure within the heat-setting die. This integral structure is more specifically shown in FIGS. 5*a, b* and *c* where it is demonstrated that the controlled preferred orientation of respective longitudinal fiber 30, 31 and 32 and transverse fiber 33, 34 and 35 within the web section continue into the rail section. By forming this continuous preferred orientation of fiber throughout the rail 38 and web section 39 (FIG. 5*a*), the desired integral structure is accomplished. It will be noted that the transverse fiber 33 provides the primary strength in tying the web and rail sections together.

As previously described, the greater thickness of the elongate rail section (shown as 38 in FIG. 5*a*) is developed by the use of additional longitudinal fiber. The increased fiber content and larger moment of inertia develop greater stiffness and strength for the sign blank and provide a rigid point of attachment for the rigid bracket and support posts.

As previously indicated, the proper amount of reinforcing fiber and accompanying resin to be used can be measured by the BASP and thickness parameters. In the preferred structure, BASP will be as high as possible. In the range of signs previously indicated, the thickness of the rail section may vary between 0.125 and 0.750 inches. In any case, the thickness must be at least twice the thickness of the web 21 or 39 to which it is attached. This two to one ratio ensures that sufficient stiffness will be established in the rail to enable its desired servicability despite winds and other forms of buffeting contact. As to specific sizes, in a sign blank having a 6×20″ dimension, the rail thickness will vary between 0.125 and 0.450 inches. In the larger sign blank of 9×40″ size, this thickness parameter would have a range of 0.250 to 0.750 inches.

In summary, therefore, the rail section is properly structured in response to several parameters. First, the rail section must be at least twice the thickness of the web section. In addition, its size must fall within the approximate range of 0.125 to 0.750 inches in total thickness. Finally, the amount of fiber and type of selected resin must establish a minimum BASP of 40,000 psi in the longitudinal axis of the rail; 25,000 psi in the longitudinal axis of the web and 5,000 psi in the vertical orientation for rail and web. When these conditions are satisfied in a rail structure which is integrally attached with the web section as described, the resultant sign blank is capable of withstanding typical wind vibrations, vandalism and other forms of impact without being broken or destroyed.

It will be noted from the figures that the preferred sign blank structure includes a web section which is bounded on two opposing horizontal sides by rail sections 22. The use of rail sections at each side provides greater stability and strength within the overall sign blank structure. Although this second rail section may not be essential where only one sign blank is being mounted at the top of the sign post, its use is preferred to give maximum strength.

Figure 3:
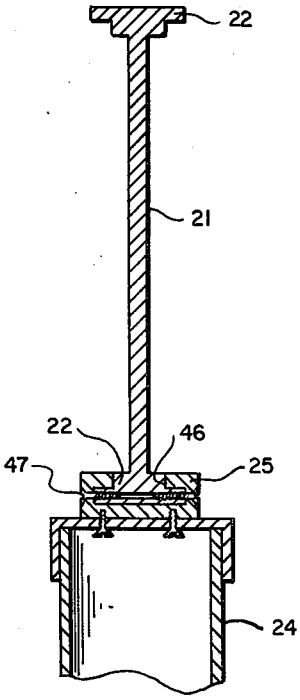
FIG. 3 is a cross-section taken along the line 3—3 of FIG. 2.

Various geometries can be selected for the rail section which will contribute to the desired stiffness and strength at the sign blank. FIGS. 2 and 3 illustrate a rail structure which is stepped from greater to narrower thickness while progressing from an exterior to interior position with respect to the web section. FIG. 4 illustrates a second geometric configuration for the rail structure having an elongated bulb shape 45. These are merely two examples and it will be apparent that many geometries could be selected which fall within the stated parameters for rail structure.

Using the latter bulb shape, the following fiber and resin percentages (based on total weight of composite material) have been experimentally determined to yield an effective sign blank within the claims of the subject invention:

a. Resin content was approximately 34% (w), both in the rail and web sections.

b. In the rail, 59% (w) roving or fiber in longitudinal orientation, compared to 7% (w) random matt or transverse fiber.

c. In the web, 46% (w) roving or fiber in longitudinal orientation, compared to 20% (w) random matt or transverse fiber.

This composite included a type E-Glass, and use of continuous strand matt. The actual values for BASP in the required orientations was determined to be as follows:

a. In the rail, 59,000 psi in the longitudinal direction and 10,000 psi at the vertical orientation; and b. In the web, 39,000 psi in the longitudinal direction and 10,000 psi at the vertical orientation.

The bulb geometry referred to above was selected as the preferred structure in view of marketing considerations, simply because the industry is acquainted with this configuration. Despite a similarity in geometry, however, the configuration used in metal signs is unlike the balanced, anisotropic properties of the composite material. For example, the tensile strength of the metal sign is isotropic and depends only on the modulus or strength of the metal. Furthermore, there is no variation in material structure between the web and rail sections of the sign blank. It should be apparent, therefore, that selection of geometric configuration in the present invention is a secondary design consideration to the more important design parameter BASP. BASP primarily depends on fiber content and orientation. Obviously the amount of fiber encapsulated will affect the thickness and geometry of the cross-section.

As previously indicated, the sign blank is attached to a rigid bracket 25 and steel post 24 as shown in the figures. It will be noted that the rigid bracket 25 will preferably have an interior channel 46 which conforms to the exterior geometry of the rail 22. In this manner, the sign blank can be inserted directly into this channel and fixed in place by the use of rivets or bolts at anchor points 47 and 48. In the case of FIGS. 2 and 3, the slotted structure of the rail assists in preventing theft of the sign by making it difficult to extract the sign from its channel housing 46.

FIG. 4 illustrates the elongated bulb configuration 45 which is shown to have a lateral projection 49 which serves a similar theft-inhibiting function. This projection, in combination with the attaching bolt or rivet 50 makes the sign blank difficult to extract from its channel within the bracket and therefore discourages such theft.

The rigid bracket disclosed in FIGS. 2 and 3 as well as the unibody bracket shown in FIG. 4 can be formed of metal or high strength plastic material. The combination street sign blank and attached bracket can be easily mounted to any steel post in accordance with existing methods.

The disclosed invention succeeds in dealing with the problem of material mismatch which has previously discouraged the use of plastics within the sign industry. Because of the substantial thickness and stiffness of the rail section in the disclosed sign blank, wear and tear is minimized and sufficient modulus and tensile strength exists to avoid failure of the material. The use of this structure enables manufacture of a sign blank having cost far below that of previous metallic sign blanks which enticed theft and vandalism. Furthermore, the fact that this sign blank can be constructed of fiber reinforced plastic gives it a resilience and survivability to impacts by vehicles or projecting objects from such vehicles. The specific locking structure illustrated between the mounting rail and the bracket can be easily incorporated to further discourage vandalism by requiring excessive time to dislocate the sign from its mounting bracket. Finally, the use of fiber reinforced plastics with thermo-setting resins provides a sign blank material which is weatherable and easily adapted for use in various colors and shapes to meet the needs and aesthetic interests in a community.

Although preferred embodiments of this invention have been disclosed herein, it will be understood by those skilled in the art that other forms of this invention can be realized without departing from the claimed subject matter as follows. For example, other fabrication techniques such as molding could be applied to realize an embodiment of the inventive structure. Likewise, other fiber arrangements are possible to develop the desired strength properties.

I claim:

1. A flexible resin and fiber composite street sign blank adapted for attachment to a rigid bracket and sign post combination comprising:

a planar web section having a horizontal side greater in length than a vertical side thereof, said web having a thickness between 0.045 and 0.250 inches and a web fiber content including (i) longitudinal fiber and (ii) fiber material having a transverse fiber component, said web fiber content with resin providing a minimum balanced anisotropic strength parameter in the longitudinal direction of approximately 25,000 psi in said web section and a minimum balanced anisotropic strength parameter in the vertical direction of 5,000 psi; and an elongate rail section extending along and being integral with said horizontal side of the web section, said rail section having a thickness of at least twice the web thickness and between 0.125 and 0.750 inches and a rail fiber content including (i) fiber material having a transverse fiber component and (ii) longitudinal fibers, said rail fiber content with resin providing a minimum balanced anisotropic strength parameter in the longitudinal direction of 40,000 psi in said rail section and a minimum balanced anisotropic strength parameter in the vertical direction of 5,000 psi, said fiber material with transverse component being continuous between the web and rail sections and along a junction therebetween.

2. A street sign blank as defined in claim 1, further comprising a second elongate rail section extending along a second horizontal side of said web section, said second rail having the same structure and composition as specified for the first rail of claim 1.

3. A street sign blank as defined in claim 1, wherein the web and rail combination is approximately six inches in height and at least twenty inches in length, said rail having a thickness approximately ranging between 0.125 to 0.450 inches and said web having a thickness within the approximate range of 0.045 to 0.200 inches.

4. A street sign blank as defined in claim 1, wherein the web and rail combination is approximately nine inches in height and at least thirty inches in length, said rail being a thickness approximately ranging between 0.250 and 0.750 inches and said web having a thickness within the approximate range of 0.060 to 0.250 inches.

5. A street sign blank as defined in claim 1, wherein said rail has a configuration which is stepped from greater to narrower thickness from an exterior to interior position with respect to the web section.

6. A street sign blank as defined in claim 1, wherein said rail has a cross-sectional configuration of an elongated bulb, said bulb having a lateral projection which extends along the length of said rail and adapts said rail to fit snugly in a slot in said rigid bracket, said slot having comparable configuration to said cross-section for locking said street sign blank therein.

* * * * *